US006565013B1

(12) United States Patent
Buergler et al.

(10) Patent No.: US 6,565,013 B1
(45) Date of Patent: May 20, 2003

(54) COMMON RAIL INJECTOR

(75) Inventors: Josef Buergler, Puch (AT); Franz Guggenbichler, Golling (AT); Peter Mueller, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/763,479

(22) PCT Filed: Jun. 23, 2000

(86) PCT No.: PCT/DE00/01975

§ 371 (c)(1),
(2), (4) Date: Apr. 26, 2001

(87) PCT Pub. No.: WO01/00980

PCT Pub. Date: Jan. 4, 2001

(30) Foreign Application Priority Data

Jun. 24, 1999 (DE) ..... 199 28 846

(51) Int. Cl.[7] ..... F02M 45/10

(52) U.S. Cl. ..... 239/95; 239/585.1; 239/533.8; 123/490

(58) Field of Search ..... 239/533.1–533.12, 239/585.1, 585.5, 124, 127, 88–95; 123/490, 499; 251/129, 129.1, 129.15, 129.22

(56) References Cited

U.S. PATENT DOCUMENTS 4,164,326 A * 8/1979 Deckard ..... 239/585.1
4,349,152 A 9/1982 Akagi
5,025,768 A * 6/1991 Eckert ..... 123/491
5,178,110 A * 1/1993 Guggenbichler et al. ... 123/300
5,397,055 A * 3/1995 Paul et al. ..... 239/533.8
5,497,750 A * 3/1996 Mueller et al. ..... 123/446
5,538,187 A 7/1996 Mueller et al.

FOREIGN PATENT DOCUMENTS

DE 43 41 543 A1 6/1995
WO WO 99/18349 4/1999

* cited by examiner

*Primary Examiner*—Michael Mar
*Assistant Examiner*—Dinh Q Nguyen
(74) *Attorney, Agent, or Firm*—Ronald E. Greigg

(57) ABSTRACT

The invention relates to a common rail injector having an injector housing (2), which communicates via a fuel inlet (3) with a central high-pressure reservoir, which is supplied with fuel from a fuel tank, which fuel, as a function of the position of a 3/2-way magnet valve (4), passes into a high-pressure bore (5) of an injection nozzle (6), and the 3/2-way magnet valve (4) has a control piston (14), which can be moved back and forth between a closed and an open valve position and which on one of its two ends is coupled with an armature (15) and whose other end projects into a pressureless chamber (9), and in the open valve position the fuel inlet (3) communicates with the high-pressure bore (5) of the injection nozzle (6), and in the closed valve position, the fuel inlet (3) is closed by the control piston (14) and the high-pressure bore (5) of the injection nozzle (6) communicates with a fuel outlet (12) and with the pressureless chamber (9).

Figure 1:
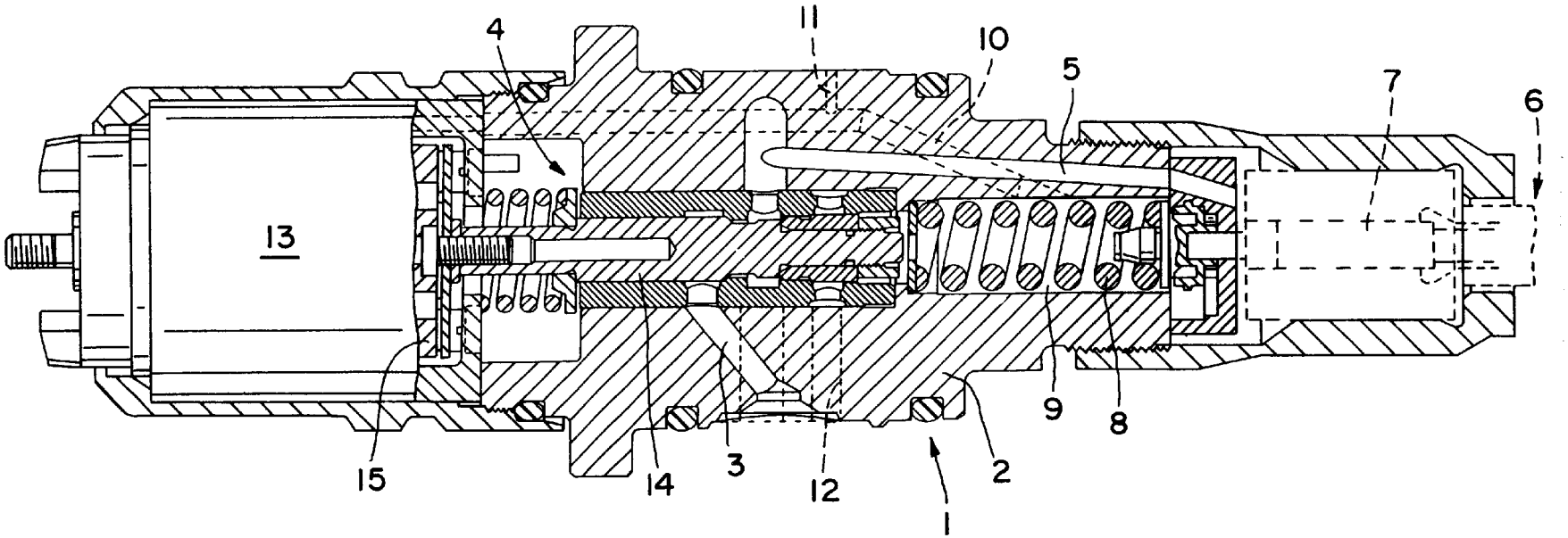

To optimize the motion of the control piston in the flight phase, a first throttle restriction (27) is disposed between the high-pressure bore (5) and the fuel outlet (12).

19 Claims, 3 Drawing Sheets

COMMON RAIL INJECTOR

CROSS-REFERENCE TO RELATED APPLICATIONS

This application is a 35 USC 371 application of PCT/DE 00/01975 filed on Jun. 23, 2000.

PRIOR ART

The invention relates to a common rail injection system for injection of fuel into an internal combustion engine, in particular a large-scale diesel engine, having an injector housing, which communicates via a fuel inlet with a central high-pressure reservoir. The reservoir is supplied with fuel from a fuel tank via a high-pressure pump, and the fuel, as a function of the position of a 3/2-way magnet valve integrated with the injector housing passes from the high-pressure reservoir into a high-pressure bore of an injection nozzle that is integrated with the injector housing and includes a nozzle needle. The nozzle needle is axially displaceable counter to the prestressing force of a nozzle spring that is received in a nozzle spring chamber, and the 3/2-way magnet valve has a control piston, which can be moved back and forth between a closed and an open valve position and which on one of its two ends is coupled with an armature and whose other end projects into a chamber which is maintained at substantially atmospheric pressure. In the open valve position, the fuel inlet communicates with the high-pressure bore of the injection nozzle, and in the closed valve position, the fuel inlet is closed by the control piston and the high-pressure bore of the injection nozzle communicates with a fuel outlet and with the chamber which is maintained at substantially atmospheric pressure. One such injector is known from German Patent Disclosure DE 43 41 543.

In common rail injection systems, a high-pressure pump pumps the fuel into the central high-pressure reservoir, which is called a common rail. From the high-pressure reservoir, high-pressure lines lead to the various injectors that are assigned to the engine cylinders. The injectors are triggered individually by the engine electronics. The rail pressure is applied to the 3/2-way magnet valve, which keeps the high-pressure bores to the conventional injection nozzle pressureless. Not until the magnet receives electric current does the 3/2-way magnet valve open the communication between the rail and the injection nozzle, and the fuel reaches the combustion chamber, bypassing the nozzle needle that is lifted counter to the force of a valve spring. Accordingly, the onset and end of injection are determined by the onset and end of a delivery of electrical current to the magnet. The duration of this delivery of current is definitive for the injection quantity.

Upon switching of the 3/2-way magnet valve, the control piston moves back and forth between the closed and the open valve position. The phase in which the control piston is located between the open and the closed valve position is called the flight phase. In experiments performed in the context of the present invention using conventional injectors, at high injection pressures of about 1500 bar in the flight phase, instabilities in the motion of the control piston have been demonstrated. These instabilities have occurred particularly whenever, at a constant rpm, the supply of current to the magnet was varied. As a result of these instabilities, the engine might no longer function correctly in the affected range.

An object of the invention is to optimize the motion of the control piston in the flight phase.

The invention includes a common rail injector for injection of fuel into an internal combustion engine, in particular a large-scale diesel engine, having an injector housing. The central high pressure reservoir communicates via a fuel inlet with a central high-pressure reservoir, which is supplied with fuel from a fuel tank via a high-pressure pump, the fuel, as a function of the position of a 3/2-way magnet valve integrated with the injector housing passes from the high-pressure reservoir into a high-pressure bore of an injection nozzle that is integrated with the injector housing and includes a nozzle needle. The nozzle needle is axially displaceable counter to the prestressing force of a nozzle spring that is received in a nozzle spring chamber. The 3/2-way magnet valve has a control piston, which can be moved back and forth between a closed and an open valve position and which on one of its two ends is coupled with an armature and whose other end projects into a chamber which is maintained at substantially atmospheric pressure. In the open valve position the fuel inlet communicates with the high-pressure bore of the injection nozzle, and in the closed valve position, the fuel inlet is closed by the control piston and the high-pressure bore of the injection nozzle communicates with a fuel outlet and with the chamber which is maintained at substantially atmospheric pressure. The invention is attained in that a first throttle restriction is disposed between the high-pressure bore and the fuel outlet. As a result, the function of the 3/2-way magnet valve becomes independent of the diversion pulse. With the throttle, the overflow quantity upon switching can be controlled.

One special type of embodiment of the invention is characterized in that a second throttle restriction is disposed between the fuel outlet and the chamber which is maintained at substantially atmospheric pressure. The second throttle restriction prevents fuel, acted upon by pressure, from reaching this chamber in the flight phase. The inflow of pressurized fuel into the this chamber could otherwise lead to pressure pulses on the end face of the control piston. These pressure pulses would counteract the valve spring force and could lead to an impairment in the function of the 3/2-way magnet valve.

A further special type of embodiment of the invention is characterized in that a sleeve for guiding the control piston is inserted into the injector housing. The sleeve can be built into the injector housing either with or without the control piston already mounted. The use of the sleeve has the advantage that in production the sleeve can be machined much more simply than the injector housing. Furthermore, a worn sleeve can easily be replaced with a new sleeve. There is no longer any need to replace the injector housing.

A further particular type of embodiment of the invention is characterized in that one opening each is disposed in the sleeve in the region of the fuel inlet, the fuel outlet and the communication with the high-pressure bore, and each opening discharges into a respective annular chamber. This assures good distribution of the fuel.

A further particular type of embodiment of the invention is characterized in that the sleeve is formed of a high-speed steel having a greater hardness than the injector housing. This markedly increases the service life of the injector.

Still another particular type of embodiment of the invention is characterized in that the diameter play at the throttle restrictions amounts to from 0.005 to 0.05 mm. In experiments performed in the context of the present invention, these values have proved to be especially advantageous.

Figure 2:
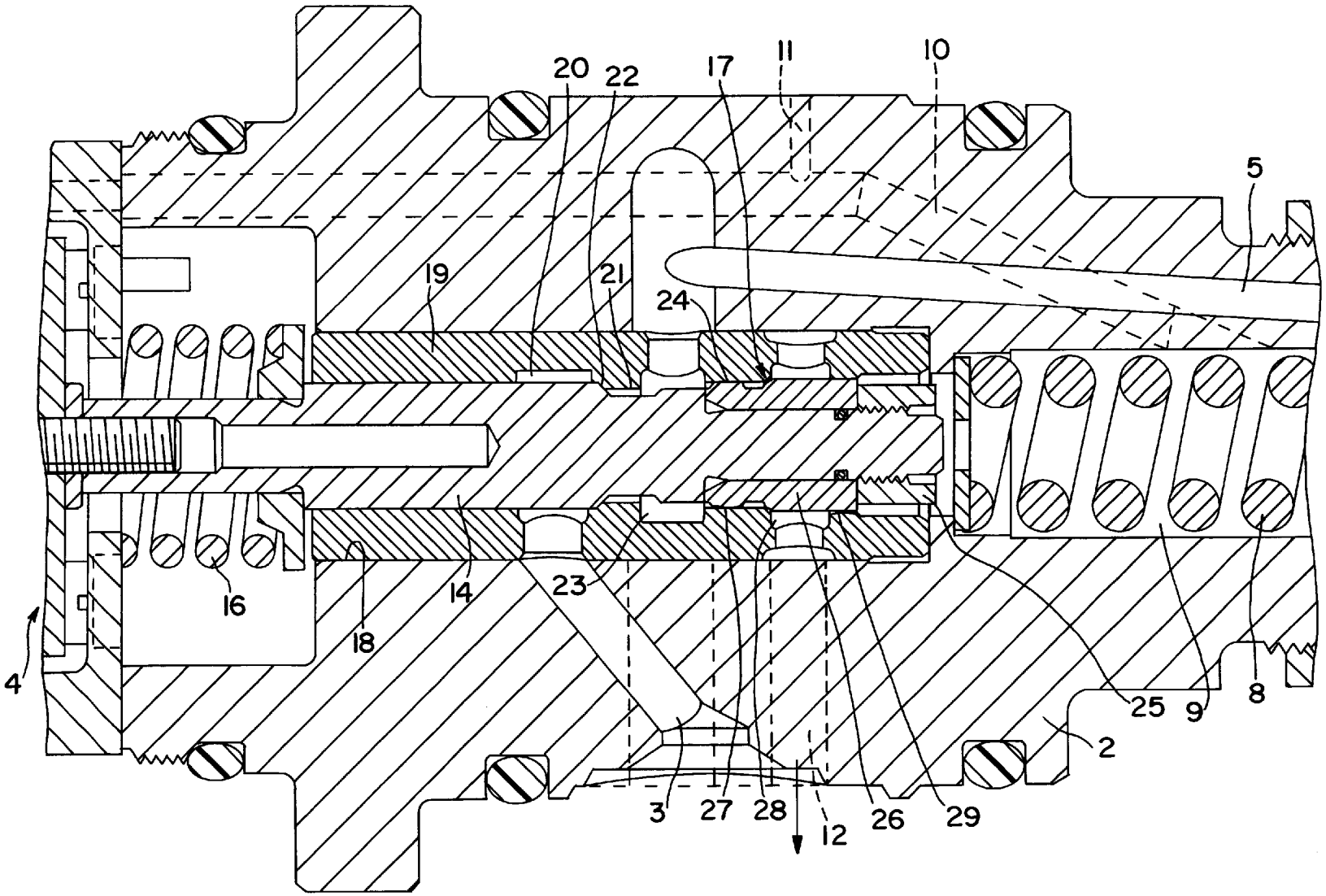

Further advantages, characteristics and details of the invention will become apparent from the ensuing description, in which two exemplary embodiments of the invention will be described in detail in conjunction with the drawing. The characteristics recited in the claims and in the description can each be essential to the invention individually and alone or in arbitrary combination. Shown in the drawing are:

FIG. 1, the view of a longitudinal section through a first embodiment of an injector according to the invention;

FIG. 2, an enlarged detail of FIG. 1; and

Figure 3:
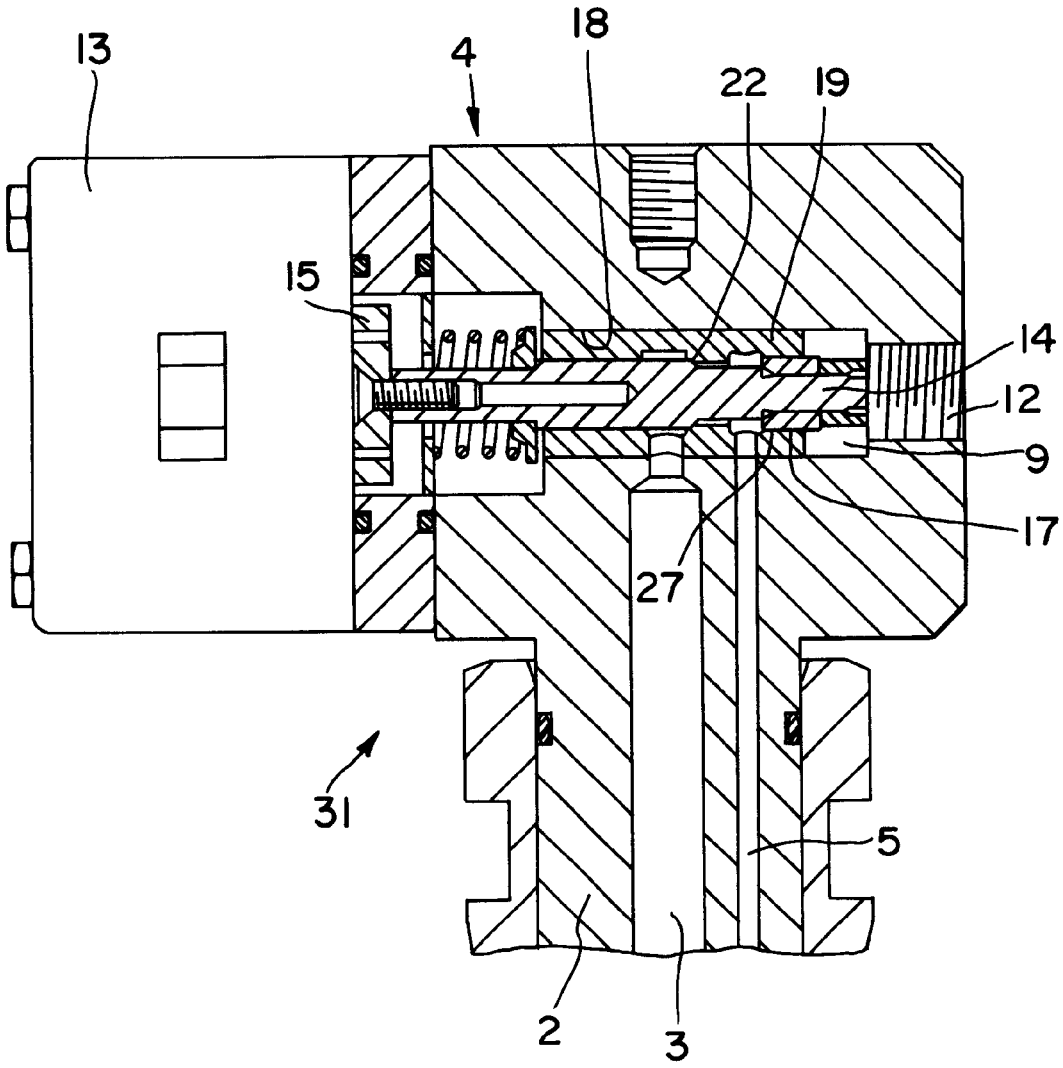

FIG. 3, a detail of a second embodiment of an injector according to the invention.

In FIG. 1, an injector according to the invention is identified overall by reference numeral 1. The injector 1 includes an injector housing 2. Through a fuel inlet 3, fuel acted upon by high pressure reaches the interior of the injector housing 2.

Depending on whether a 3/2-way valve 4 is in the open or the closed position, the fuel from the fuel inlet 3 reaches a high-pressure bore 5. The high-pressure bore 5 leads to an injection nozzle 6. The injection nozzle 6 includes a nozzle needle 7, which is pressed by a nozzle spring 8 against a nozzle needle seat. The nozzle spring 8 is disposed in a nozzle spring chamber 9. The fuel accumulating during operation in the nozzle spring chamber 9 is carried away via a fuel conduit 10 and a throttle 11.

In the closed position of the 3/2-way valve 4, the high-pressure bore 5 communicates with a fuel outlet 12. The 3/2-way magnet valve 4 includes a magnet 13, for moving a control piston 14 back and forth counter to the prestressing force of a valve spring 16. The control piston 14 is coupled to an armature 15, which cooperates with the magnet 13.

As seen from FIG. 2, the control piston 14 is received in a bore 18 in the injector housing 2. A sleeve 19 is disposed between the control piston 14 and the injector housing 2. The sleeve 19 is shrink-fitted into the injector housing 2 and serves to guide the control piston 14 axially. A first annular chamber is recessed out of the sleeve 19 in the region of the fuel inlet 3. The inside diameter of the sleeve 19 is dimensioned differently on the two sides of the first annular chamber 20. On the side toward the valve spring 16, the inside diameter of the sleeve 19 is greater than on the side of the first annular chamber 20 remote from the valve spring 16. On the side of the first annular chamber 20 remote from the valve spring 16, there is accordingly a portion 21 of somewhat reduced inside diameter. A first cone seat 22 is formed between the first annular chamber 20 and the portion 21.

The portion 21 is followed by a second annular chamber 23. The second annular chamber 23 communicates with the high-pressure bore 5. The second annular chamber 23 is followed by a portion 24 of the sleeve 19 that has the same inside diameter as on the side of the sleeve 19 facing away from the first annular chamber 20 and toward the valve spring 16.

A bushing 26 is slipped onto the free end of the control piston 14 and is secured with the aid of a nut 25. Between the bushing 26 and the portion 24 of the sleeve 19, a first throttle restriction 27 is formed. From a production standpoint and in terms of the expense of assembly, it is more favorable to integrate the nut or the thread with the bushing. Then the bushing 26 can be screwed onto the control piston 14, and the nut 25 is omitted.

The first throttle restriction 27 is followed, in the region of the fuel outlet 12, by a third annular chamber 28. A second throttle restriction 29 is formed between the third annular chamber 28 and the nozzle spring chamber 9.

In FIG. 3, an injector identified overall by reference numeral 31 is shown in fragmentary form. In an injector housing 2, a fuel inlet 3 is disposed longitudinally of the injector housing 2. The fuel inlet 3 is either closed or communicates with a high-pressure bore 5, depending on the position of a 3/2-way magnet valve 4. The high-pressure bore 5 leads to an injection nozzle, not shown in FIG. 3. In the closed position of the 3/2-way magnet valve 4, the high-pressure bore 5 communicates with a fuel outlet 12. The 3/2-way valve 4 includes a magnet 13, which with the aid of an armature 15 actuates a control piston 14 counter to the prestressing force of a valve spring 16. As long as there is no current to the magnet 13, the valve spring 16 assures that the fuel inlet 3 remains closed.

A sleeve 19 is shrink-fitted into a bore 18, which extends transversely to the longitudinal axis of the injector 31.

The sleeve 19 has the same function as in the embodiment described above in conjunction with FIGS. 1 and 2. In the closed position of the 3/2-way valve 4, a first cone seat 22 is closed. When current is supplied to the magnet 13, the control piston 14 moves toward the magnet 13, counter to the prestressing force of the valve spring 16. The first cone seat 22 then opens. The motion of the control piston 14 continues until such time as a second cone seat 17 closes. A throttle restriction 27 is formed between the high-pressure bore 5 and the second cone seat 17.

The foregoing relates to preferred exemplary embodiments of the invention, it being understood that other variants and embodiments thereof are possible within the spirit and scope of the invention, the latter being defined by the appended claims.

We claim:

1. A common rail injector for injection of fuel into a large-scale internal combustion diesel engine, comprising an injector housing (2), which communicates via a fuel inlet (3) with a central high-pressure reservoir, which is supplied with fuel from a fuel tank via a high-pressure pump, the fuel, as a function of a position of a 3/2-way magnet valve (4) integrated with the injector housing (2) passes from the high-pressure reservoir into a high-pressure bore (5) of an injection nozzle (6) that is integrated with the injector housing (2) and includes a nozzle needle (7), the nozzle needle is axially displaceable counter to a prestressing force of a nozzle spring (8) that is received in a nozzle spring chamber (9), and the 3/2-way magnet valve (4) has a control piston (14), which can be moved back and forth between a closed and an open valve position and which on a first end is coupled with an armature (15) and a second end extends into a pressureless chamber (9), and in the open valve position the fuel inlet (3) communicates with the high-pressure bore (5) of the injection nozzle (6), and in the closed valve position, the fuel inlet (3) is closed by the control piston (14) and the high-pressure bore (5) of the injection nozzle (6) communicates with a fuel outlet (12) and with the pressureless chamber (9), and a first throttle restriction (27) is disposed between the high-pressure bore (5) and the fuel outlet (12).

2. The injector of claim 1, in which a second throttle restriction (29) is disposed between the fuel outlet (12) and the pressureless chamber (9).

3. The injector of claim 2, in which a sleeve (19) is inserted into the injector housing (2) for guiding the control piston (14).

4. The injector of claim 3, in which one opening is disposed in the sleeve (19), in a region of the fuel inlet (3), the fuel outlet (12) and the communication with the high-pressure bore (5), and each opening discharges into a respective annular chamber (20, 23, 28).

5. The injector of claim 4, in which the sleeve (19) is formed of a high-speed steel having a greater hardness than the injector housing (2).

6. The injector of claim 4, in which a diameter play at the throttle restrictions (27, 29) amounts to from 0.005 to 0.05 mm.

7. The injector of claim 3, in which the sleeve (19) is formed of a high-speed steel having a greater hardness than the injector housing (2).

8. The injector of claim 7, in which a diameter play at the throttle restrictions (27, 29) amounts to from 0.005 to 0.05 mm.

9. The injector of claim 3, in which a diameter play at the throttle restrictions (27, 29) amounts to from 0.005 to 0.05 mm.

10. The injector of claim 2, in which a diameter play at the throttle restrictions (27, 29) amounts to from 0.005 to 0.05 mm.

11. The injector of claim 1, in which a sleeve (19) is inserted into the injector housing (2) for guiding the control piston (14).

12. The injector of claim 11, in which one opening is disposed in the sleeve (19), in a region of the fuel inlet (3), the fuel outlet (12) and the communication with the high-pressure bore (5), and each opening discharges into a respective annular chamber (20, 23, 28).

13. The injector of claim 12, in which the sleeve (19) is formed of a high-speed steel having a greater hardness than the injector housing (2).

14. The injector of claim 13, in which a diameter play at the throttle restrictions (27, 29) amounts to from 0.005 to 0.05 mm.

15. The injector of claim 12, in which a diameter play at the throttle restrictions (27, 29) amounts to from 0.005 to 0.05 mm.

16. The injector of claim 11, in which the sleeve (19) is formed of a high-speed steel having a greater hardness than the injector housing (2).

17. The injector of claim 16, in which a diameter play at the throttle restrictions (27, 29) amounts to from 0.005 to 0.05 mm.

18. The injector of claim 11, in which a diameter play at the throttle restrictions (27, 29) amounts to from 0.005 to 0.05 mm.

19. The injector of claim 1, in which a diameter play at the throttle restrictions (27, 29) amounts to from 0.005 to 0.05 mm.

* * * * *